US008186009B2

(12) United States Patent
Smith et al.

(10) Patent No.: US 8,186,009 B2
(45) Date of Patent: May 29, 2012

(54) VACUUM CLEANER EQUIPPED WITH AGITATOR AND CLUTCH ASSEMBLY

(75) Inventors: Shawn M. Smith, Lancaster, KY (US); Shannon D. Phegley, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 1433 days.

(21) Appl. No.: 11/687,375

(22) Filed: Mar. 16, 2007

(65) Prior Publication Data

US 2008/0223407 A1 Sep. 18, 2008

(51) Int. Cl.
*A47L 9/02* (2006.01)

(52) U.S. Cl. ..... 15/390; 15/41.1; 15/4; 15/52.1; 15/79.2; 15/83

(58) Field of Classification Search ..... 15/390, 15/41.1, 42, 52.1, 79.2, 83
See application file for complete search history.

(56) References Cited

U.S. PATENT DOCUMENTS

| | | | | | |
|---|---|---|---|---|---|
| 1,332,235 | A | | 3/1920 | Staples | |
| 1,726,592 | A | | 9/1929 | Spanel | |
| 2,140,143 | A | * | 12/1938 | Sellers et al. | 15/332 |
| 2,175,004 | A | * | 10/1939 | Snyder | 15/332 |
| 2,218,035 | A | | 10/1940 | Benson | |
| 2,499,330 | A | * | 2/1950 | Reeves | 15/330 |
| 2,502,674 | A | * | 4/1950 | Sellers | 15/332 |
| 2,504,846 | A | * | 4/1950 | Kirby | 15/319 |
| 2,601,698 | A | * | 7/1952 | Humphrey | 15/390 |
| 2,627,623 | A | | 2/1953 | Humphrey | |
| 2,682,681 | A | | 7/1954 | Balluff | |
| 3,049,744 | A | | 8/1962 | MacFarland | |
| 3,188,681 | A | * | 6/1965 | Jepson et al. | 15/337 |
| 4,421,964 | A | | 12/1983 | Buchtel | |
| 4,446,595 | A | | 5/1984 | Nakada et al. | |
| 4,581,787 | A | | 4/1986 | Torigoe et al. | |
| 4,610,047 | A | | 9/1986 | Dick et al. | |
| 4,660,247 | A | * | 4/1987 | Frohbieter et al. | 15/339 |
| 4,748,714 | A | * | 6/1988 | Tschudy | 15/390 |
| 4,766,640 | A | | 8/1988 | Martin et al. | |
| 5,311,638 | A | | 5/1994 | Furcron et al. | |
| 5,537,712 | A | | 7/1996 | Weber et al. | |
| 5,617,610 | A | | 4/1997 | Dearaujo | |
| 5,768,746 | A | | 6/1998 | Kamatani et al. | |
| 5,839,160 | A | * | 11/1998 | Wang et al. | 15/390 |
| 6,067,689 | A | * | 5/2000 | Roney et al. | 15/390 |
| 6,098,243 | A | | 8/2000 | Kim | |
| 6,158,084 | A | | 12/2000 | Weber et al. | |
| 6,209,168 | B1 | | 4/2001 | Brickner et al. | |
| 6,438,793 | B1 | | 8/2002 | Miner et al. | |

(Continued)

FOREIGN PATENT DOCUMENTS

DE 1 954 002 5/1970

(Continued)

*Primary Examiner* — Robert Scruggs
(74) *Attorney, Agent, or Firm* — King & Schickli, PLLC

(57) ABSTRACT

An upright vacuum cleaner includes a nozzle assembly having a suction inlet and a rotary agitator. A canister assembly is pivotally connected to the nozzle assembly. The vacuum cleaner also includes a suction generator and a dirt collection vessel. Still further, the vacuum cleaner includes a clutch assembly for controlling power transmission from the drive motor of the suction generator to the rotary agitator. The clutch assembly includes a pulley driven by the drive motor, a first clutch element connected to the pulley, a second clutch element connected to the rotary agitator and an actuator for displacing the second clutch element between a first, engaged position and a second, disengaged position.

11 Claims, 4 Drawing Sheets

U.S. PATENT DOCUMENTS

| | | | | |
|---|---|---|---|---|
| 6,691,849 | B1 * | 2/2004 | Dyson et al. | 192/55.1 |
| 6,915,544 | B2 | 7/2005 | Roney et al. | |
| 7,228,593 | B2 * | 6/2007 | Conrad | 15/390 |
| 7,665,172 | B1 * | 2/2010 | Tran et al. | 15/41.1 |
| 2004/0117942 | A1 | 6/2004 | Roney | |
| 2004/0134025 | A1 | 7/2004 | Murphy et al. | |
| 2004/0216266 | A1 * | 11/2004 | Conrad | 15/412 |
| 2005/0278892 | A1 | 12/2005 | Bosses | |
| 2006/0075599 | A1 * | 4/2006 | Kimmerle et al. | 15/383 |
| 2007/0028413 | A1 * | 2/2007 | Fischer et al. | 15/334 |
| 2008/0127450 | A1 * | 6/2008 | Hawkins et al. | 15/389 |

FOREIGN PATENT DOCUMENTS

| | | | |
|---|---|---|---|
| GB | 1 602 788 | | 11/1981 |
| GB | 2271275 | A * | 4/1994 |

* cited by examiner

VACUUM CLEANER EQUIPPED WITH AGITATOR AND CLUTCH ASSEMBLY

TECHNICAL FIELD

The present relates generally to the floor care equipment field and, more particularly, to an upright vacuum cleaner equipped with an agitator including a clutch assembly that allows interruption of drive to the agitator for bare floor cleaning.

BACKGROUND OF THE INVENTION

A vacuum cleaner is an electro-mechanical appliance utilized to effect the dry removal of dust, dirt and other small debris from carpets, rugs, fabrics or other surfaces in domestic, commercial and industrial environments. In order to achieve the desired dirt and dust removal, most vacuum cleaners incorporate a rotary agitator. The rotary agitator is provided to beat dirt and debris from the nap of the carpet or rug while a pressure drop or vacuum is used to force air entrained with this dirt and debris into the nozzle of the vacuum cleaner. The particulate laden air is then drawn into a dirt collection vessel. The air is then drawn through a filter before being directed through the motor of the suction generator to provide cooling. Finally, the air is filtered to remove any fine particles of carbon from the brushes of that motor or other dirt that might remain in the air-stream before being exhausted back into the environment.

While a rotary agitator is particularly beneficial in cleaning dirt and debris from the nap of a carpet or rug, it has long been known that the turbulence produced by a rapidly rotating agitator often interferes with the efficient cleaning of dirt and debris from a bare floor such as a hardwood or linoleum covered floor. Thus, for bare floor cleaning applications it is desirable to interrupt power to the rotary agitator. Where an upright vacuum cleaner incorporates a separate drive motor for the agitator, this is easily accomplished by simply de-energizing that dedicated drive motor. However, in order to lower production costs, minimize weight and reduce the size of an upright vacuum cleaner, many upright vacuum cleaners drive the rotary agitator through a power takeoff connected to the motor of the suction generator.

The interruption of the drive between the motor of the suction generator and the rotary agitator has taken many forms. Often, power is transmitted from the drive shaft of the suction generator motor to the agitator by means of a belt. In one approach a belt shifter is provided to shift the belt between the agitator drive pulley and an idler pulley to interrupt power transmission to the agitator. An example of just such an approach is disclosed in U.S. Pat. No. 5,768,746 to Kamatani et al. In yet another approach, an idler pulley is utilized to tension the drive belt to provide drive to the agitator and de-tension the drive belt to interrupt drive to the agitator. Such an approach is disclosed in, for example, U.S. Pat. No. 5,537,712 to Weber et al. and U.S. Pat. No. 6,915,544 to Roney et al.

In still another approach a displaceable belt shaft is provided to disengage the drive belt from the drive shaft of the suction generator motor when it is desired to interrupt power to the agitator. Such an approach is disclosed in U.S. Pat. No. 6,098,243 to Kim. In yet another approach, power is transmitted by a belt from the drive shaft of the suction generator drive motor to a pulley adjacent and axially aligned with the agitator. A first clutch disc is provided on the pulley and a second clutch disc is provided on the agitator. The clutch discs are engaged and disengaged by shifting the pulley toward and away from the agitator.

The present invention relates to an agitator equipped with a clutch assembly that may be disengaged to interrupt power to the rotary agitator without tensioning, stretching or otherwise manipulating the drive belt or any of the pulleys to which the drive belt is connected.

SUMMARY OF THE INVENTION

In accordance with the purposes of the present invention as described herein, an upright vacuum cleaner is provided comprising a nozzle assembly including a suction inlet and a rotary agitator. The vacuum cleaner further includes a canister assembly that is pivotally connected to the nozzle assembly. A suction generator is carried on one of the nozzle assembly and the canister assembly. The suction generator includes a drive motor. Additionally, a dirt collection vessel is carried on the canister assembly. Still further, the vacuum cleaner includes a clutch assembly for controlling power transmission from the drive motor to the rotary agitator.

The clutch assembly includes a pulley driven by the drive motor, a first clutch element connected to the pulley, a second clutch element connected to the rotary agitator and an actuator. The actuator allows the operator to displace the second clutch element between a first position wherein the second clutch element is engaged with the first clutch element so as to provide drive to the rotary agitator and a second position wherein the second clutch element is disengaged from the first clutch element so as to interrupt the drive to the rotary agitator. In one possible embodiment both the first clutch element and the second clutch element are frustoconical in shape.

More specifically describing the invention, the rotary agitator includes an axle carried by the nozzle assembly. The rotary agitator includes an agitator body having a first end cap and a second end cap. The first end cap carries a first bearing and the second end cap carries a second bearing. The first and second bearings allow the agitator body to freely rotate on the axle. In addition, the pulley is mounted on a third bearing and freely rotates on the same axle.

The first end cap is engaged by the actuator and the second end cap is connected to the second clutch element. Further, a compression spring is received over the axle and extends between the first clutch element and the second end cap. The compression spring functions to bias the rotary agitator and second clutch element to the second or disengaged position.

In one possible embodiment the actuator includes a switch button, a linkage and a drive block. A first mounting block receives the first end of the axle and a second mounting block receives the second end of the axle. The drive block is received over a hub of the first mounting block and the axle.

In a second possible embodiment the actuator includes a switch button, a linkage, a first wedge cam secured to the linkage, a drive block and a second wedge cam secured to the drive block. Further, a first mounting block receives a first end of the axle and a second mounting block receives a second end of the axle. The drive block is received over a hub of the first mounting block and the axle.

Still further, the dirt collection vessel may take the form of a filter bag or a dirt cup. In one possible embodiment, that dirt cup contains a primary filter.

In accordance with an additional aspect of the present invention, a method is provided for interrupting the drive to a rotary agitator from a drive motor of a suction generator in an upright vacuum cleaner. That method includes the steps of (a)

providing a clutch assembly between the rotary agitator and the drive motor and (b) longitudinally translating the rotary agitator between a first position wherein the clutch assembly is engaged to provide drive to the rotary agitator and a second position wherein the clutch assembly is disengaged to interrupt drive to the rotary agitator.

In the following description there is shown and described several preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention and together with the description serves to explain certain principles of the invention. In the drawings.

Reference will now be made in detail to the present preferred embodiments of this invention, examples of which are illustrated in the accompanying drawings.

DETAILED DESCRIPTION OF THE INVENTION

Figure 1:
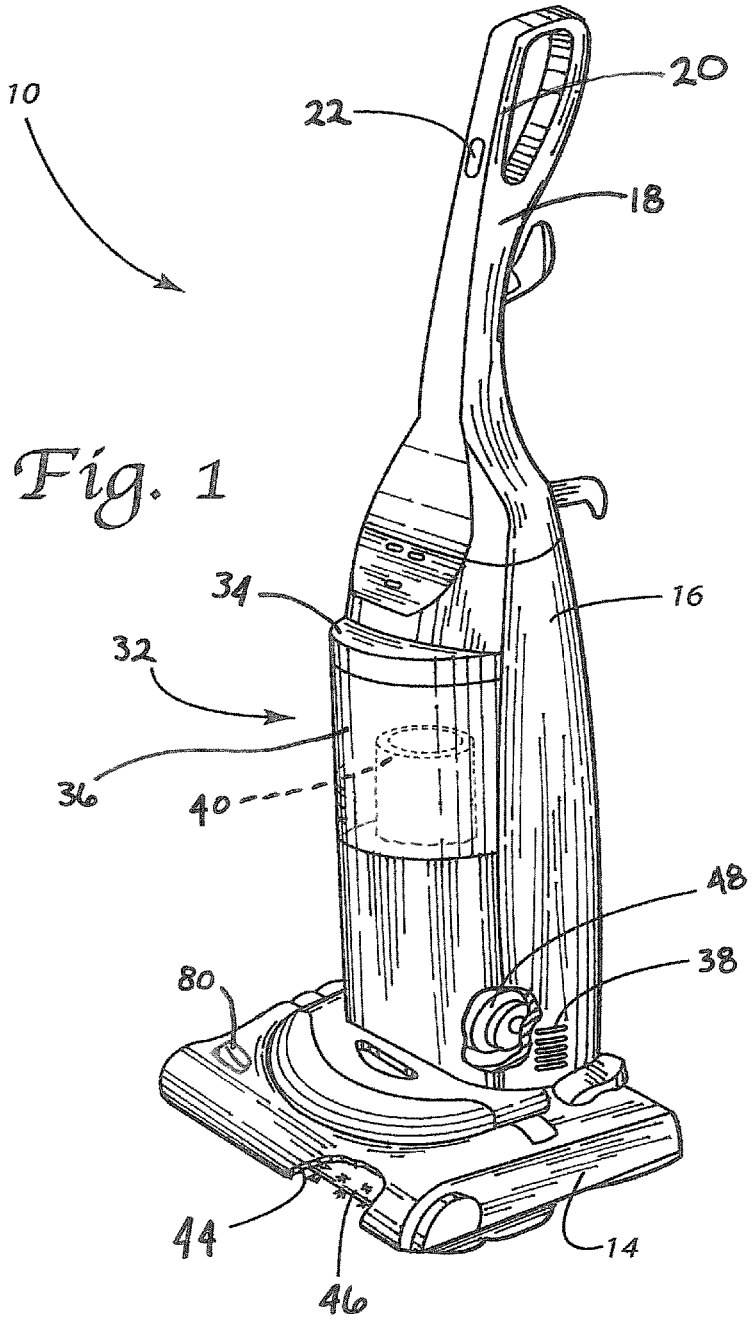
FIG. 1 is a perspective view of the vacuum cleaner of the present invention.

Reference is now made to FIG. 1 showing the upright vacuum cleaner 10 of the present invention. The upright vacuum cleaner 10 includes a housing comprising a nozzle assembly 14 and a handle or canister assembly 16. The canister assembly 16 further includes a control handle 18 and a handgrip 20. A control switch 22 is provided for turning the vacuum cleaner 10 on and off. Of course, electrical power is supplied to the vacuum cleaner 10 from a standard electrical wall outlet through an electrical cord (not shown).

A pair of rear wheels (not shown) are provided on the lower portion of the canister assembly 16 and a pair of front wheels (also not shown) are provided on the nozzle assembly 14. Together, these wheels support the vacuum cleaner 10 for movement across the floor. To allow for convenient storage of the vacuum cleaner 10, a foot latch (not shown) functions to lock the canister assembly in an upright position as shown in FIG. 1. When the foot latch is released, the canister assembly 16 may be pivoted relative to the nozzle assembly 14 as the vacuum cleaner 10 is manipulated back and forth to clean the floor.

In the presently illustrated embodiment, the canister assembly 16 includes a cavity adapted to receive and hold the dirt collection vessel 32. The dirt collection vessel 32 may take the form of a dirt cup 34 including a cylindrical sidewall 36, a tangentially directed inlet and an axially directed outlet. A primary filter 40 may be provided in the dirt cup 34 over the axially directed outlet. The primary filter 40 is cylindrical in shape and concentrically received within the cylindrical sidewall 36 of the dirt cup 34. Such a structural arrangement induces cyclonic airflow in the dirt cup 34 and provides for enhanced cleaning efficiency. In an alternative design, the canister assembly 14 includes a closed compartment that houses a filter or vacuum cleaner bag, of a type known in the art, that functions as the dirt collection vessel 32.

The nozzle assembly 14 includes a suction inlet 44. A rotary agitator 46 is carried on the nozzle assembly 14 so as to extend across the suction inlet 44. A suction generator 48, including a fan and a cooperating drive motor, is carried on the canister assembly 16. The suction generator 48 functions to generate a vacuum air stream for drawing dirt and debris from the surface to be cleaned. The rotary agitator 46 is connected by power take off to the motor of the suction generator 48. While the suction generator 48 is illustrated as being carried on the canister assembly 16, it should be appreciated that, alternatively, it could be carried on the nozzle assembly 14 if desired.

During normal vacuum cleaner operation, the rotary agitator 46 is driven by the motor of the suction generator and functions to beat dirt and debris from the nap of an underlying carpet. The suction generator 48 functions to draw a vacuum air stream into the suction inlet 44. Dirt and debris from the carpet is entrained in the air stream, which is then drawn by the suction generator 48 into the dirt cup 34. Dirt and debris is captured in the dirt cup 34 while relatively clean air is drawn through the primary filter 40. That air stream passes over the motor of the suction generator 48 to provide cooling before being exhausted through a final filter, such as a HEPA filter (not shown) before being exhausted through an exhaust port 38 into the environment.

Figure 2:
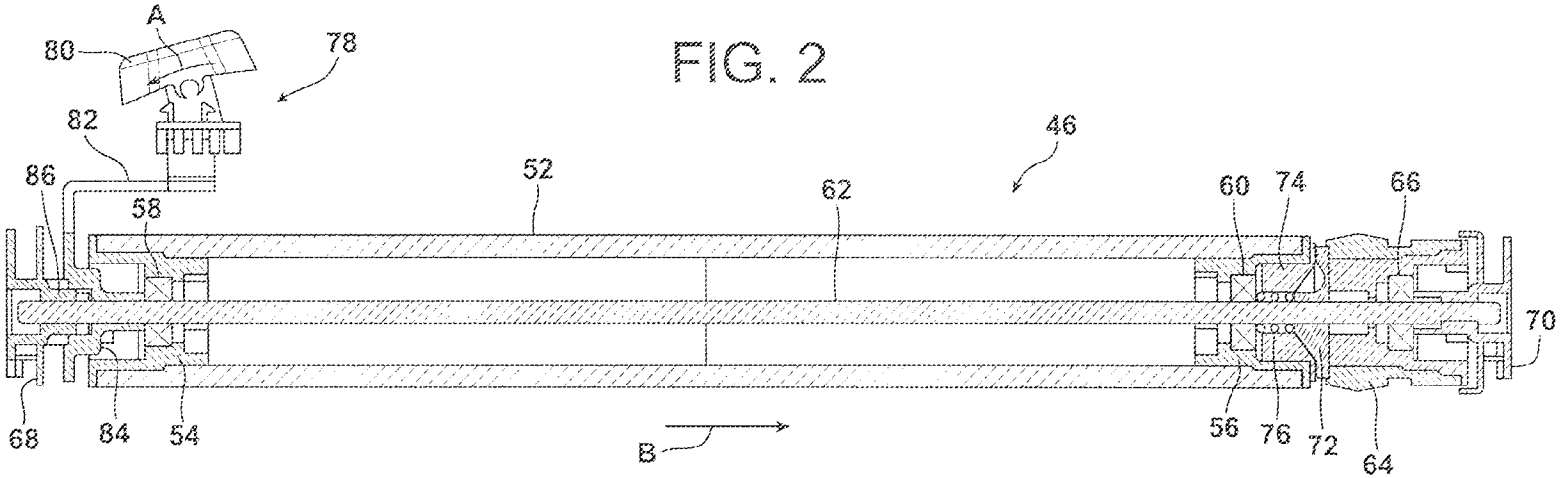
FIG. 2 is a detailed cross sectional view of a rotary agitator incorporating a first embodiment of the clutch assembly in the normal or carpet cleaning position.
Figure 3:
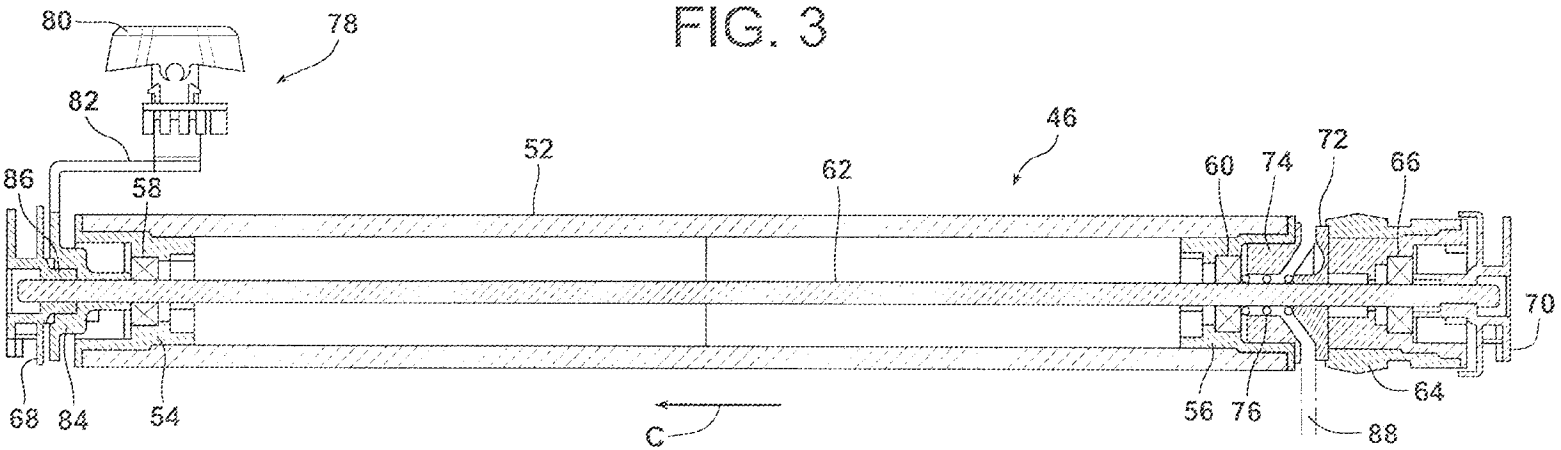
FIG. 3 is an illustration similar to FIG. 2 but showing that embodiment in the bare floor cleaning position.

Reference is now made to FIGS. 2 and 3 illustrating in detail the rotary agitator 46 and a first possible embodiment of the clutch assembly 50 for controlling power transmission from the drive motor of the suction generator 48 to the rotary agitator. As illustrated in FIGS. 2 and 3, the rotary agitator 46 includes an agitator body 52 that carries bristles, brushes, beater bars, membranes or other cleaning elements (not shown) of a type known in the art. The agitator body 52 is tubular and incorporates a first end cap 54 at one end and a second end cap 56 at the other end. The first end cap 54 receives and holds a first bearing assembly 58 while the second end cap 56 receives and holds a second bearing assembly 60. The agitator body 52 is received over and carried on an axle 62. More specifically, the first and second bearing assemblies 58, 60 allow the agitator body to freely rotate on the axle 62.

As further illustrated in FIGS. 2 and 3, a pulley 64 includes a third bearing assembly 66. Like the agitator body 52, the pulley 64 is mounted on the axle 62. The third bearing assembly 66 ensures that the pulley 64 freely rotates on the axle 62. The pulley 64 is connected by a belt (not shown) to the drive shaft of the motor of the suction generator 48. The axle 62 is secured in the nozzle assembly 14 by means of first and second mounting blocks 68, 70. More specifically, each mounting block 68, 70 is received in a cooperating pocket or socket that is molded or otherwise fixed to the housing of the nozzle assembly 14 in a manner known in the art.

Besides the pulley 64, the clutch assembly 50 includes a first clutch element 72 connected to the pulley 64 and a cooperating second clutch element 74 connected to the second end cap 56 of the rotary agitator 46. As clearly illustrated, each clutch element 72, 74 is frustoconical in shape so as to provide a larger mating surface area when the clutch assembly 50 is engaged to drive the rotary agitator 46 as illustrated in FIG. 2. This enhances operating efficiency, resists slipping and ensures a long service life. A compression spring 76 received over the axle 62 and extending between the first clutch element 72 and the second end cap 56 functions to bias the first clutch element 72 and rotary agitator 46 away from the second clutch element 74 into the disengaged position illustrated in FIG. 3.

The clutch assembly 50 further includes an actuator, generally designated by reference numeral 78. The actuator 78 allows the operator of the vacuum cleaner 10 to selectively displace the second clutch element 74 between a first position wherein the second clutch element is engaged with the first clutch element 72 so as to provide drive to the rotary agitator 46 (see FIG. 2) and a second position wherein the second clutch element is disengaged from the first clutch element so as to interrupt drive to the rotary agitator (see FIG. 3). As illustrated in FIGS. 2 and 3, the actuator 78 includes a switch button or foot pedal 80, a linkage 82 and a drive block 84. The drive block 84 is received over a hub 86 of the first mounting block 68 and the axle 62.

As illustrated in FIG. 2, the switch button/foot pedal 80 is depressed thereby pivoting in the direction of action arrow A. This causes the linkage 82, drive block 84, agitator 46 and second clutch element 74 to all shift axially along the axle 62 in the direction of action arrow B, overcoming the biasing force of the compression spring 76 and forcing the second clutch element 74 into engagement with the first clutch element 72 (note, end of drive block 84 engages inner race of first bearing assembly 58). Thus, as the motor of the suction generator 48 drives the pulley 64, the rotary agitator 46 is also driven and rotates at the desired speed to provide efficient and effective cleaning of the nap of a carpet.

When the operator wishes to disengage the clutch assembly 50 and stop rotation of the rotary agitator 46 to allow more effective and efficient cleaning of a bare floor, the right side of the switch button 80 is depressed (see FIG. 3). This causes the linkage 82, the drive block 84, the rotary agitator 46 and the second clutch element 74 under the force of the compression spring 76 to actually shift along the axle 62 in the direction of action arrow C. This functions to disengage the clutch assembly 50 by producing a gap 88 between the first and second clutch elements 72, 74. In this position, the motor of the suction generator 48 continues to drive the pulley 64 but that rotation is not imparted to the rotary agitator 46 through the clutch assembly 50. Accordingly, the rotary agitator 46 is no longer driven and it thereby comes to a halt. This allows more effective and efficient cleaning of a bare floor.

An alternative embodiment of the clutch assembly 50 is illustrated in FIGS. 4-7. In this embodiment, the rotary agitator 46 including the agitator body 52, first end cap 54, second end cap 56, first bearing assembly 58, second bearing assembly 60 and axle 62 remain unchanged. Similarly, the pulley 64 and third bearing assembly 66 as well as the mounting blocks 68 and 70 remain unchanged. So do the first clutch element 72 and second clutch element 74 as well as the compression spring 76. It is the actuator 90 that differs. More specifically, the actuator 90 includes a switch button or foot pedal 92, a linkage 94, a first wedge cam 96 secured to the linkage 94, a drive block 98 and a second wedge cam 100 secured to the drive block 98.

Figure 4:
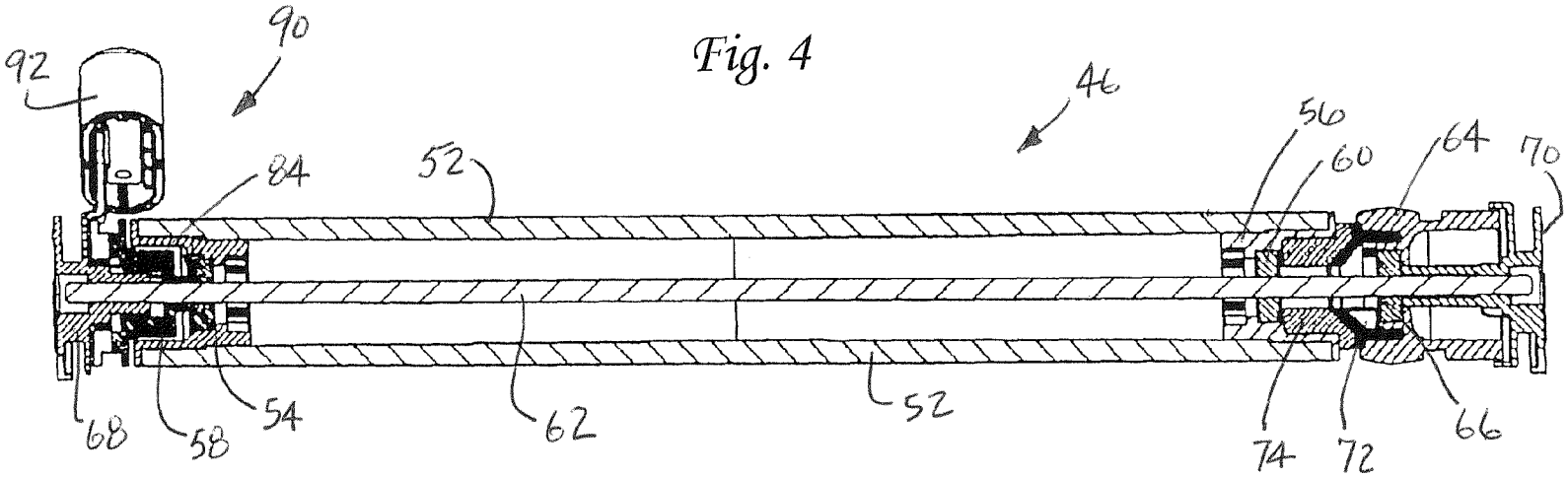
FIG. 4 is a detailed cross sectional view of an agitator incorporating a second embodiment of the clutch assembly in the normal or carpet cleaning position.
Figure 6:
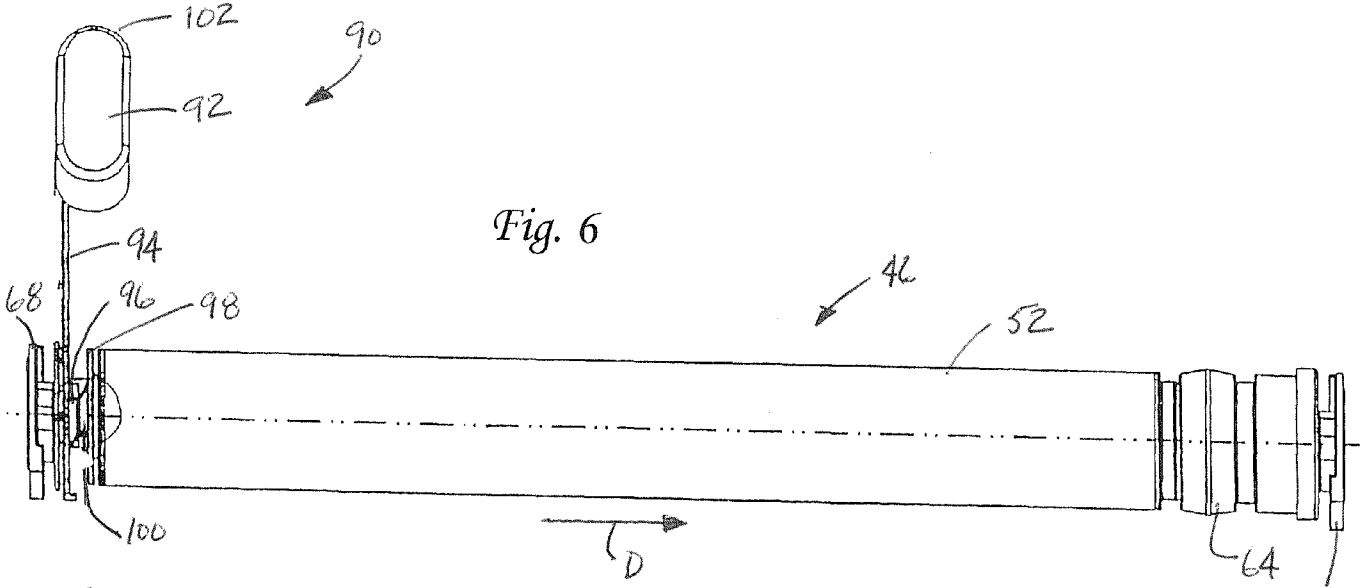
FIGS. 6 and 7 are top plan views corresponding respectively to FIGS. 4 and 5.

The clutch assembly 50 is illustrated in the first or engaged position in FIGS. 4 and 6. More specifically, when the end 102 of the switch button 92 is depressed, the wedge cams 96, 100 are forced into an overlapping or stacked position. This causes the drive block 98, rotary actuator 46 and second clutch element 74 to shift axially along the axle 62 in the direction of action arrow D. This causes the second clutch element 74 to engage with the first clutch element 72 so that the rotary agitator 46 rotates with the pulley 64 as the pulley 64 is driven by the motor of the suction generator 48. Thus, the rotary agitator 46 is rotated at a desired speed to provide efficient and effective cleaning of the nap of an underlying rug or carpet.

Figure 5:
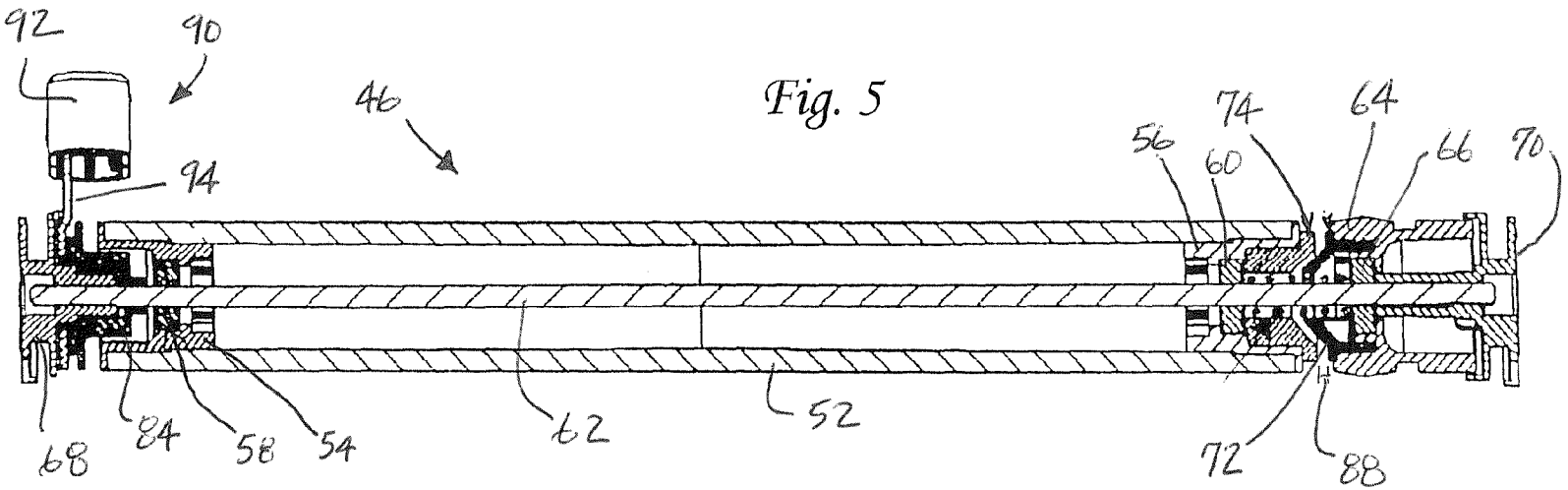
FIG. 5 is an illustration similar to FIG. 4 but showing that embodiment in the bare floor cleaning position.
Figure 7:
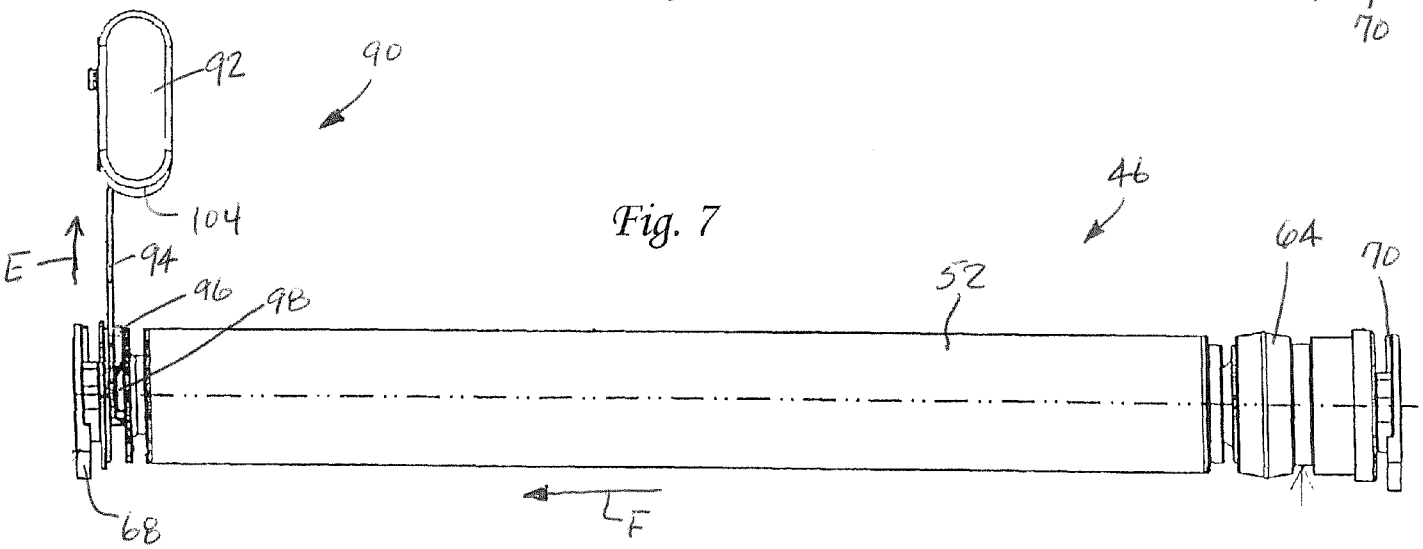

The rotary agitator 46 may be disengaged for bare floor cleaning in the manner illustrated in FIGS. 5 and 7. More specifically, the opposite end 104 of the switch button 92 is depressed. This causes the first wedge cam 96 on the linkage 94 to shift upwardly in the direction of action arrow E in FIG. 7 so that the wedge cams 96, 100 are aligned rather than overlapping or stacked as illustrated in FIG. 6. As a result, the drive block 98, rotary agitator 46 and second clutch element 74 are biased by the compression spring 76 axially along the axle 62 in the direction of action arrow F. This produces a gap 88 between the first and second clutch elements 72, 74. As a result, while the pulley 64 continues to be driven by the motor of the suction generator 48, the rotary agitator 46 is not. Thus, the rotary agitator 46 stops so as to allow the operator to more effectively clean a bare floor.

It should be appreciated that in either of the illustrated embodiments, it is the agitator body 52 that is shifted or translated longitudinally along the axle 62 to engage or disengage the clutch assembly 50. The bearing assembly 66 of pulley 64 is fixed to the axle 62 so as to prevent the pulley 64 from translating or shifting longitudinally along the axle 62. As a result, the belt extending between the pulley 64 and the drive shaft of the drive motor of the suction generator 48 is not subjected to tensioning, stretching or any geometry changes that could adversely affect or shorten its useful service life.

The method of the present invention allows for the interrupting of the drive to a rotary agitator from a drive motor of a suction generator in an upright vacuum cleaner. The method includes the step of providing a clutch assembly between the rotary agitator 46 and the suction generator drive motor 48. In addition, the method includes the step of longitudinally translating or shifting at least one portion of the rotary agitator 46 between a first position wherein the clutch is engaged to provide drive to the rotary agitator and a second position wherein the clutch is disengaged to interrupt drive to the rotary agitator.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed:

1. An upright vacuum cleaner, comprising:

a nozzle assembly including a suction inlet and a rotary agitator;

a canister assembly pivotally connected to said nozzle assembly;

a suction generator carried on one of said nozzle assembly and said canister assembly, said suction generator including a drive motor;

a dirt collection vessel carried on said canister assembly; and a clutch assembly for controlling power transmission from said drive motor to said rotary agitator, said clutch assembly including;

(a) a pulley driven by said drive motor;

(b) a first clutch element connected to said pulley;

(c) a second clutch element connected to said rotary agitator; and (d) an actuator, including a switch button, a linkage and a drive block, said actuator engaging said rotary agitator, said actuator displacing said rotary agitator and second clutch element between a first position wherein said second clutch element is engaged with said first clutch element so as to provide drive to said rotary agitator and a second position wherein said second clutch element is disengaged from said first clutch element so as to interrupt drive to said rotary agitator;

said vacuum cleaner being characterized by said rotary agitator, said pulley, said first clutch element and said second clutch element all sharing a common axis of rotation where said rotary agitator has an axle carried by said nozzle assembly and an agitator body having a first end cap and a second end cap, said first end cap carrying a first bearing and said second end cap carrying a second bearing, said first and second bearing allowing said agitator body to freely rotate on said axle and wherein said pulley freely rotates on said axle and said first end cap is engaged by said actuator and said second end cap is connected to said second clutch element; and said vacuum cleaner further including a compression spring received over said axle and extending between said first clutch element and said second end cap.

2. The vacuum cleaner of claim 1, further including a first mounting block that receives a first end of said axle and a second mounting block that receives a second end of said axle.

3. The vacuum cleaner of claim 2, wherein said drive block is received over a hub of said first mounting block and said axle.

4. The vacuum cleaner of claim 1, wherein said actuator includes a switch button, a linkage, a first wedge cam secured to said linkage, a drive block arid a second wedge cam secured to said drive block.

5. The vacuum cleaner of claim 4, further including a first mounting block that receives a first end of said axle and a second mounting block that receives a second end of said axle.

6. The vacuum cleaner of claim 5, wherein said drive block is received over a hub of said first mounting block and said axle.

7. The vacuum cleaner of claim 1, wherein said dirt collection vessel is a filter bag.

8. The vacuum cleaner of claim 1, wherein said dirt collection vessel is a dirt cup.

9. The vacuum cleaner of claim 8, wherein said dirt cup contains a primary filter.

10. The vacuum cleaner of claim 1 wherein said first clutch element and said second clutch element are both frustoconical in shape.

11. The vacuum cleaner of claim 1, wherein said common axis of rotation is said axle that extends through said rotary agitator, said pulley, said first clutch element and said second clutch element.

* * * * *